United States Patent [19]

Colin et al.

[11] Patent Number: 4,836,969

[45] Date of Patent: Jun. 6, 1989

[54] METHOD OF CASTING A STRUCTURE FROM CEMENTITIOUS

[75] Inventors: Laurence Colin, Cross River; Vincent A. Pardiso, Scarsdale, both of N.Y.

[73] Assignee: Cemtech Laboratories Inc., New Milford, Conn.

[21] Appl. No.: 44,349

[22] Filed: Apr. 30, 1987

[51] Int. Cl.[4] ..... B28B 1/20

[52] U.S. Cl. ..... 264/311; 425/145; 425/426; 425/435

[58] Field of Search ..... 264/310, 311, 312, 270; 425/435, 145, 426, 365, 374

[56] References Cited

U.S. PATENT DOCUMENTS

| | | | |
|---|---|---|---|
| 857,588 | 6/1907 | Boyle | 264/314 X |
| 3,720,493 | 3/1973 | Borcoman et al. | 425/435 X |
| 3,723,044 | 3/1973 | Moth et al. | 425/435 |
| 4,666,521 | 5/1987 | Colin | 106/97 |
| 4,686,075 | 8/1987 | Dziewanowski et al. | 264/310 X |

*Primary Examiner*—Jan H. Silbaugh
*Assistant Examiner*—Karen D. Kutach
*Attorney, Agent, or Firm*—E. Lieberstein

[57] ABSTRACT

A process for forming a hollow cast structure of cementitious material using a hollow mold having a predetermined surface geometry corresponding to the surface geometry of the structure to be cast. The cementitious material is an admixture of hydraulic cement, water and particles of aggregate containing presized, inorganic filler particles having a maximum size of about 50 microns in a predetermined proportion to the hydraulic cements such that the admixture is substantially non-dilatent and thixotropic. The admixture is fed into the hollow mold against the predetermined surface geometry from a feeding device separated a predetermined distance from the mold surface while simultaneously rotating the mold relative to the admixture.

9 Claims, 2 Drawing Sheets

METHOD OF CASTING A STRUCTURE FROM CEMENTITIOUS

FIELD OF INVENTION

The present invention relates to a method of casting a cement structure.

BACKGROUND OF INVENTION

Casting is a process of forming a structure by introducing a fluid material into a cavity or mold in which the material is allowed to solidify. The shape of the cast structure is determined by the configuration of the mold. Many materials are cast including metals, plastics, rubber and cement.

Heretofore, casting of cementitious materials was limited to a gravity feed method of vertically pouring the cementitious mix into a form or mold which defines a pattern for establishing the exterior or interior configuration of the cast structure. The form or mold may be made from wood, ceramic, metal, plastic or other resilient materials including latex, rubber or silicone. The admixture cures in the mold with a surface configuration conforming to the surface configuration of the mold.

The mold for a cast cement structure in addition to defining the shape of the cast is also used, at present, to hold the cementitious mix in a stationary position until the initial set has occurred. During the pouring operation, the mold is vibrated to aid in uniformly distributing the mix within the mold and to eliminate entrapped air. Agitation of the mold is known to cause migration of heavy aggregate to the bottom of the mold and separation of lighter particles to the top. The more the uncured material is agitated, the greater the segregation. The fluidity of the mix based on the water added will also contribute to segregation. Accordingly, following conventional practice, some segregation is unavoidable and basically a tradeoff to achieve relative homogeneity and to eliminate entrapped air.

The cementitious mixtures of Portland cement and aggregate presently used for casting have a high slump value to provide good flow characteristics. Such cement mixtures also exhibit a high degree of dilatency. The degree to which the mix gives off free water is a measure of the dilatency of the admixture. Dilatency results in an alternation in the water cement ratio which, in turn, affects the cure properties of the mix. The degree of segregation and latence increase with agitation and increased slump. Thus, the physical properties of the cured concrete may vary from area to area within the casting.

Once the mold is filled and leveled, conventional practice requires a quiescent period of immobility. Using conventional high slump value Portland-aggregate mixes, the mix must be held immobile to cure properly without cracking. Otherwise, the cast product will be flawed.

For all the above reasons, present day molded cast products have limited utility and generally exhibit poor surface finish and high porosity. Moreover, it is difficult using conventional cement casting techniques to cast a single molded cement structure of relatively unlimited length. The size of the structure is also a constraint.

In a companion patent application, U.S. Ser. No. 783,868, filed Oct. 3, 1985, now U.S. Pat. No. 4,666,521 the disclosure of which is herewith incorporated by reference, a cementitious admixture is described comprising hydraulic cement, presized inorganic filler particles and water mixed in a predetermined proportion to form a thixotropic nondilatent cementitious composition. Thixotropy develops when dilatency is minimal so that flow will occur only when the mix is subjected to a shearing force. It has been found in accordance with the present invention that using a cementitious admixture which is substantially non-dilatent in a mold which is rotated will provide a product with a high surface finish less porosity and of a substantially greater density than conventionally formed cement cast structures. Ornamental concrete designs and concrete pipe or columns can be cast using the method of the present invention. By rotating the mold rotational forces cause displacement of the material to the outermost walls of the cavity of the mold. Segregation of the particles is avoided by the use of an admixture which is thixotropic. The technique disclosed by the present invention permits castings to be made of any length as long as the mandrel or rotational fixture can support the weight of the casting and as long as the mixture can be inserted into the mold hollow core.

SUMMARY OF THE INVENTION

The method of the present invention comprises preparing a cementitious admixture of hydraulic cement, water and particles of aggregate containing presized inorganic filler particles having a maximum size of about 50 microns in a predetermined proportion to the hydraulic cement such that the admixture is substantially non-dilatent and thixotropic, introducing the admixture into a mold for defining the shape of the structure and simultaneously rotating the mold.

OBJECTS OF THE INVENTION

It is a principal object of the present invention to provide a method of casting a structure in a rotating mold from cementitious material.

It is a further object of the present invention to provide a method for casting objects which require rotational symmetry such as a pipe from cementitious material without limitation in the size or length of the object to be cast.

DETAILED DESCRIPTION OF THE INVENTION

Figure 1:
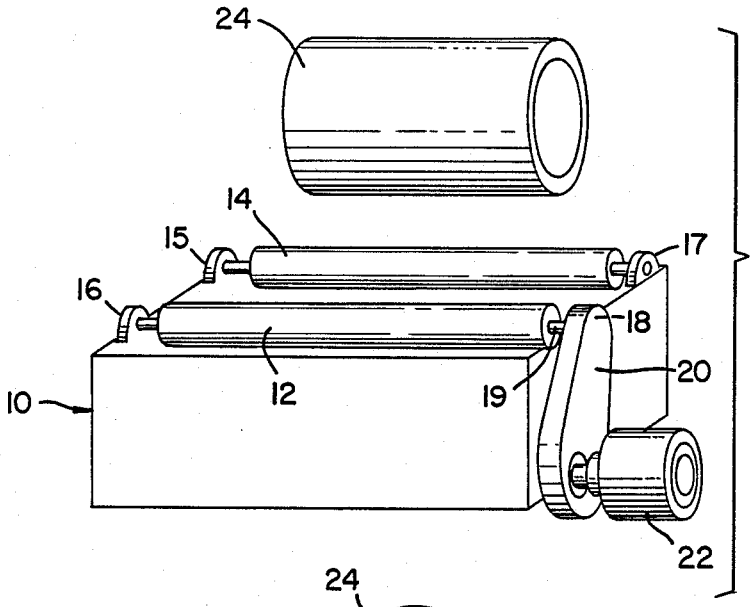
FIG. 1 is a perspective view of a preferred arrangement for rotating the mold in carrying out the method of the present invention.
Figure 2:
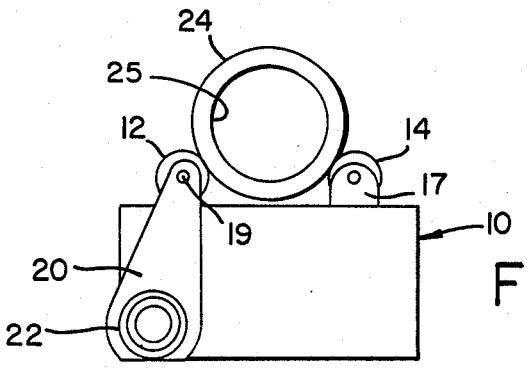
FIG. 2 is a side elevation of the arrangement of FIG. 1 showing the mold mounted in position for rotation.

Referring now, in particular, to FIGS. 1 and 2 which show a preferred assembly for carrying out the method of the present invention comprising a table 10 which supports rollers 12 and 14 journaled for rotation in lugs 15, 16, 17 and 18, which extend upright from the table 10. The shaft 19 of roller 12 extends into one end of a chain guard assembly 20 which rotates the roller 12 at a controlled rotational speed by an electric motor 22 which is coupled to the opposite end of the chain guard assembly 20. The roller 14 is a free wheeling or idler roller.

Figure 3B:
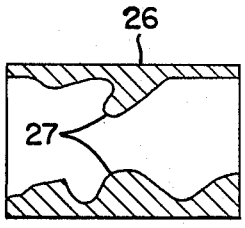
FIG. 3B is a side cross sectional view of the mold of FIG. 3A.
Figure 3A:
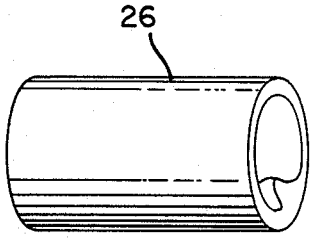
FIG. 3A is a perspective of an alternate mold configuration for use in the assembly of FIG. 1.
Figure 4:
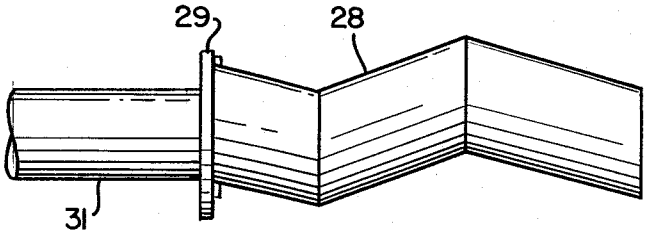
FIG. 4 is a side elevational of yet another mold configuration and mounting arrangement for use in the assembly of FIG. 1.

A hollow mold 24 having a cylindrical configuration is adapted to be mounted upon the rollers 12 and 14 as shown in FIG. 3A for rotation about a horizontal axis coincident with the longitudinal axis of the mold 24. The interior geometry 25 of the mold 24 should conform to the desired shape for the cast structure. Accordingly, the interior shape 25 of the mold 24 must be cylindrical to produce a cylindrical cast. The mold 25 as shown in FIG. 3B has an external cylindrical geometry and a non-cylindrical internal surface configuration 27 for forming a structure of non-cylindrical configuration such as an ornamental object, a die or a cam. Another non-cylindrical mold 28 is shown in FIG. 4 for producing a non-cylindrical cast structure. In this case, the non-cylindrical mold 28 is attached to a face plate 29 which, in turn, is connected to a centric mandrel 31 for rotation between the rollers 12 and 14.

Figure 5:
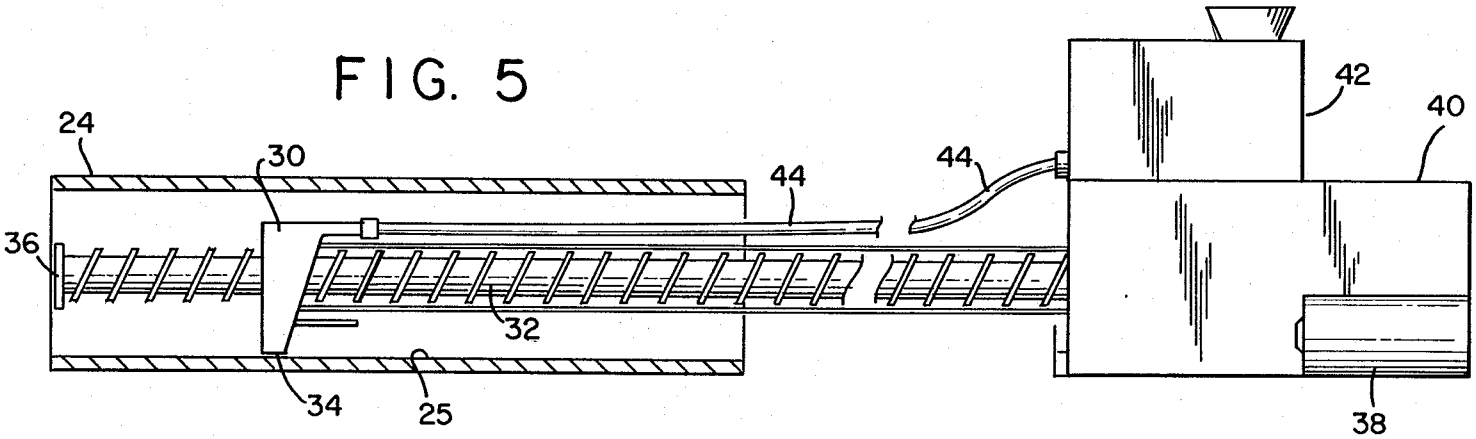
FIG. 5 is a side elevational partly in cross section of a motorized feeding mechanism for introducing cement into the mold of FIG. 1.

An aqueous cementitious admixture is introduced in the mold 24, 26 or 28 preferably with the mold in rotation. A preferred feeding assembly for introducing the aqueous cementitious mix into the mold is diagrammatically shown in FIG. 5. A feeding head 30 and feed screw 32 is shown disposed within the hollow interior of the mold 24 for dispensing the admixture through the throat 34 of the feeding head 30. The cementitious mix is deposited onto the interior wall surface 25 of the mold 24 to form a structure replicating the surface geometry of the mold, i.e., if the surface 25 is cylindrical the cast structure will be cylindrical with a controlled wall thickness "d" based substantially on the cement mix feed rate and the distance between the throat 34 and the surface 25 of the mold 24. The distance of the throat 34 from the wall 25 may be made adjustable i.e., telescope within the feeding head 30 or a different size feeding head may be substituted, to vary the annular wall thickness of the cast structure such that when the feeding device is held a predetermined distance from the interior surface of the mold, the thickness of the cast structure is controlled This is particularly advantageous for forming pipe of predetermined wall thickness.

Although the mold 24 is preferably rotated while the feeding head 30 is axially driven along the longitudinal axis of the mold 24 from one end of the mold 24 to its opposite end it is obvious that the mold 24 may be stationary and the feeding head 30 rotated as well as being axially driven. The feeding head 30 is driven along the feed screw 32 from the end plate 36, which is inserted within the mold 24 to coincide with one end of the mold, by means of an electric motor 38 mounted in a housing 40. A cement pump 42 is also affixed to the main housing 40 for driving an aqueous cementitious mix through a supply line 44 into the feeding head 30.

The speed of relative rotation between the mold 24 and the feeding head 30 is dependent upon the fluidity of the cementitious mix and the feed rate of the mix through the feeding head 30. A minimum speed of generally about 200 RPM has been found satisfactory to achieve a reasonably dense cast structure in a range of 8 to 12 inches in diameter with minimum porosity. The speed of rotation may be substantially higher but should be below the speed at which centrifugal forces would cause separation between particles in the mix. The mold is preferably removed after the cement initial cure begins.

The preferred aqueous cementitious mixture should include an hydraulic cement, preferably portland cement, water and particles of aggregate containing presized inorganic filler particles having a maximum particle size of about 50 microns, and preferably below 44 microns and in a relationship by weight to the hydraulic cement of $C/2=F$, where C represents the hydraulic cement and F represents only the presized filler particles in the aggregate. The admixture should be reasonably fluid with the water content preferably in a minimum proportion of $F=H_2O$ by weight.

Any conventional inorganic filler material preferably a mineral filler and most preferably silica (silicon dioxide) may be used for the presized inorganic filler particles. Natural sand which has been presized in accordance with the present invention is the preferred choice. Other conventional inorganic filler particles include alumina, calcium carbonate, calcium sulfate, calcium metasilicate, magnesium silicate, barium sulfate, mica and synthetic inorganic particles such as for example zeeospheres a trademark product of Zeeland Industries of St. Paul, Minn.

Although only the miximum particle size is critical to the present invention, it is preferred that the particles be at least above micron size, i.e., above about one micron as opposed to the submicron or microsilica size particles. As the size particles get smaller, they occupy less volume and are lighter. Accordingly, many more particles are required to satisfy the criteria of the present invention. Since particles at 38 microns will perform as well as particles of one micron in size, it is far less expensive to use the larger particles up to the maximum permitted size than smaller size particles. The actual choice is based on coat. However, it should be kept in mind that inorganic filler particles such as natural sand are not commercially available in uniform sizes but rather in graded sizes below a maximum designated size. Accordingly, silica particles presently available at e.g., 5 microns in size in reality contain a major proportion of micro size particles, i.e., below one micron in size. The present invention does not limit the gradation in particle size but places a premium on larger micron size particles up to the maximum permitted size i.e., the preferred range should include a major percentage of the particles between about 1 to about 50 microns in size with 50 microns being the approximate upper limit.

By way of example, a dense, cast pipe having a high surface finish was formed in accordance with the present invention using a cementitious admixture containing by volume 1 part portland cement, 1.5 parts presized filler particles between 0.5 to 50 microns in size, 3 parts conventional graded sand aggregate and water.

The method of the present invention has no limitation on the length of the pipe or its size. The internal face of the cast cylinder can also be finished to a smooth condensed surface by using, for example, a steel curved float that is retracted as the mold rotates.

Although the mold is shown for rotation about its longitudinal axis for forming pipe and other tubing where rotational symmetry is required, it is obvious that the mold may be rotated about a vertical or other non-horizontal axis for forming structures that do not require rotational symmetry. It is also obvious that the cast structure can be composed of a cementitious admixture within which other components are added to enhance the properties of the casting. Such other additives may include particles of metal, wood, resins or other organic particles, ceramics, rubber or other particles of aggregate and color pigments.

What is claimed is:

1. A method of casting a hollow structure from cementitious material comprising preparing a cementitious admixture of hydraulic cement, water and particles of aggregate containing presized inorganic filler particles having a maximum size of about 50 microns in a predetermined proportion to said hydraulic cement such that said admixture is substantially nondilatent and thixotropic, feeding said admixture onto a predetermined surface of a hollow mold having a predetermined surface geometry corresponding to the surface geometry of said hollow structure to be cast with said admixture being fed against said predetermined surface from a feeding device having throat means through which said admixture is fed with said throat means spaced a predetermined distance from said predetermined surface for controlling the hollow wall thickness of said cast structure while simultaneously rotating said mold relative to said admixture and moving said throat means axially relative to said mold to form said hollow cast structure with said predetermined surface geometry and hollow wall thickness.

2. A method of casting as defined in claim1 wherein said proportion of presized inorganic filler particles to cement in said admixture should conform to the relationship of $C/2=F$ where C represents said hydraulic cement by weight and F where C represents said hydraulic cement by weight and F represents only said presized inorganic filler in said aggregate by weight.

3. A method of casting as defined in claim 2 wherein said mold is rotated about a substantially horizontal axis.

4. A method as defined in claim 3 wherein said presized inorganic filler particles are selected from the group consisting of silica, calcium carbonate, calcium sulfate, magnesium silicate and mica.

5. A method of casting as defined in claim 4 wherein said mold has a non-cylindrical exterior geometry.

6. A method as defined in claim 4 wherein said admixture is fed into said hollow mold through said feeding device starting from a given end of said mold and linearly retracting said feeding device at a predetermined rate as said mold rotates.

7. A method of casting as defined in claim 4 wherein said has a cylindrical exterior geometry.

8. A method of casting as defined in claim 7 wherein said has an interior shape which is cylindrical.

9. A method of casting as defined in claim 7 wherein said mold has an interior shape which is non-cylindrical.

* * * * *